US007765899B2

(12) United States Patent
Nieh

(10) Patent No.: US 7,765,899 B2
(45) Date of Patent: Aug. 3, 2010

(54) SOCKET ASSEMBLY FOR QUICKLY RELEASING OBJECT ENGAGED WITH THE SOCKET

(76) Inventor: Yeu-Perng Nieh, 6980 Whiteoak Drive, Richmond, B.C. (CA) V7E 4Z9

( * ) Notice: Subject to any disclaimer, the term of this patent is extended or adjusted under 35 U.S.C. 154(b) by 0 days.

(21) Appl. No.: 12/437,128

(22) Filed: May 7, 2009

(65) Prior Publication Data

US 2009/0211409 A1 Aug. 27, 2009

Related U.S. Application Data

(63) Continuation-in-part of application No. 11/900,990, filed on Sep. 14, 2007, now abandoned.

(51) Int. Cl.
*B25B 13/06* (2006.01)

(52) U.S. Cl. ..... 81/125; 81/124.1; 81/180.1

(58) Field of Classification Search ..... 81/125, 81/124.1, 180.1, 184, 185, 13
See application file for complete search history.

(56) References Cited

U.S. PATENT DOCUMENTS

| | | | | | |
|---|---|---|---|---|---|
| 135,842 | A * | 2/1873 | Post | ..... | 81/125 |
| 2,262,434 | A * | 11/1941 | Vanerstrom | ..... | 81/125 |
| 2,805,594 | A * | 9/1957 | Fogel | ..... | 81/125 |
| D526,172 | S * | 8/2006 | Lin | ..... | D8/29 |
| 7,243,579 | B2 * | 7/2007 | Hennessey et al. | ..... | 81/125 |

* cited by examiner

*Primary Examiner*—Hadi Shakeri

(57) ABSTRACT

A socket assembly includes a socket having a mounting hole which includes a plurality of insides and yield recesses located alternatively between the insides. A control member is rotatably mounted to the socket and has a through hole, a plurality of stops extend inward from an inner periphery of the through hole. The stops are deformable when being applied with a force along the axis of the through hole. A polygonal object can be forced into the mounting hole by squeezing and bending the stops. After the object is loosened and received in the socket, the stops support the nut from dropping from the mounting hole. When the control member is rotated to off align the stops from the path that the corners of the polygonal object may drop, the object is easily take out from the socket.

7 Claims, 7 Drawing Sheets

SOCKET ASSEMBLY FOR QUICKLY RELEASING OBJECT ENGAGED WITH THE SOCKET

FIELD OF THE INVENTION

This is a Continuation-In-Part application of the inventor's former application U.S. patent application Ser. No. 11/900,990, filed on Sep. 14, 2007 now abandoned.

BACKGROUND OF THE INVENTION

A conventional socket generally includes a polygonal hole for accommodating the object such as a bolt head or a nut, the socket is driven by a hand tool so as to loosen the object from another object. However, when the bolt is threadedly connect to a board for example, and located in a deep position, when using the socket to loosen the bolt, the loosened bolt drops from the socket due to gravity and the user cannot retrieve the bolt conveniently. Some sockets are equipped with a spring ring which is installed in the socket such that the loosened bolt can be retained in the socket by the spring ring. The bolt and the socket are then removed from the deep position and the bolt can then be pulled out from the socket. Nevertheless, if the object is a nut which is completely received in the socket, the user cannot conveniently pick the nut out from the socket.

U.S. Pat. No. 7,243,579 to Hennessey discloses a rotatable ring secured around the second end of the cylindrical body and an insert having polygonal outer circumference is received in the polygonal opening of the cylindrical body. The polygonal outer circumference of the insert is sized to fit snugly into the polygonal opening of the cylindrical body. The insert includes patterned array of projections or teeth extending into the central space of the donut-shaped insert and the projections or teeth are deformable so as to conform to several tee cap sizes and designs.

However, the insert cannot rotated relative to the cylindrical body because its polygonal outer circumference is sized to fit snugly into the polygonal opening of the cylindrical body. The rotatable ring includes a lip which forms a polygonal lip opening corresponding to the polygonal opening of the cylindrical body. The rotatable ring is rotated between the non-locking position for allowing the removable of the insert, or locking position so as to prevent the removal of the insert.

When rotating the cylindrical body, if the tee cap is smaller than the central space of the insert, this means a gap is defined between the inner walls of the central space and the tee cap, no torque is applied to the tee cap. In other words, the insert cannot loosen or tighten the tee cap accommodated in the insert.

Besides, the lip opening of the rotatable ring has to be shifted to the non-locking position where the polygonal lip opening is in alignment with the polygonal opening, the cap/tool holder insert can be inserted into the cylindrical body. Once the insert is inserted into the cylindrical body, the lip opening of the rotatable ring has to be shifted again to the locking position to prevent the insert the insert from dropping off from the cylindrical body. The user has to rotate the rotatable ring after the insert has been inserted into the cylindrical body, otherwise, the insert will drop off from the cylindrical body.

Furthermore, the rotatable ring has to be rotated to the locking position to prevent the insert from dropping off from the cylindrical body before inserting the cylindrical body to the deep position where the tee cap is located. The locking position of the lip opening may preclude the insertion of the tee cap into the insert. The rotatable ring is a flat ring which is located at the second end of the cylindrical body and the second end of the cylindrical body has to be inserted into a deep position where the underground pipeline system is located. The lip could be pressed by the cylindrical body on an surface or ground, so that the user is difficult or cannot touch or rotate the rotatable ring during operation to shift the lip opening to the non-locking position so as to allow the tee cap to enter the central space of the insert.

The present invention intends to provide a socket assembly which is cooperated with a control member which includes stops extending from an inner periphery thereof and the stops are deformed when mounting the socket assembly to a nut, and after the nut is loosened, the nut is removed from the threaded rod together with the socket assembly. The control member does not need to rotate during operation. The nut is supported by the stops and does not drop off from the socket assembly until the user rotate the control member. The socket assembly is easily to use and save a lot of time.

SUMMARY OF THE INVENTION

The present invention relates to a socket assembly that comprises a socket and a control member, wherein the socket includes an engaging hole in a first end thereof and a mounting hole in a second end of the socket. The mounting hole includes a plurality of insides and yield recesses located alternatively between the insides. A groove is defined in an outer periphery of the socket and about an axis of the socket. A control member is rotatably mounted to the socket and has a through hole defined centrally therethrough. A plurality of stops extend inward from an inner periphery of the through hole and can be deformed when being applied a force along the axis of the through hole. A ridge extends inward from an inner periphery thereof and the ridge is movably engaged with the groove.

A distance "Al" from an axis of the control member to each one of the stops of the control member is not smaller than a distance "Cl" from the axis of the socket to each of the insides of the socket and is not larger than a distance "C2" from the axis of the socket to each of the yield recesses of the socket. A distance "A2" from an axis of the control member to the inner periphery of the through hole is not smaller than a distance "C2" from the axis of the socket to each of the yield recesses of the socket.

The primary object of the present invention is to provide a socket assembly which has a control member rotatably mounted thereto and the control member includes stops which are located at the path along which the object in the socket may drop. The polygonal object can be directly squeezed into the mounting hole and is supported when it is loosened from the threaded rod, the control member does not need to be rotated during operation of the socket assembly.

The control member only needs to be rotated when removing the polygonal object from the mounting hole of the socket.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
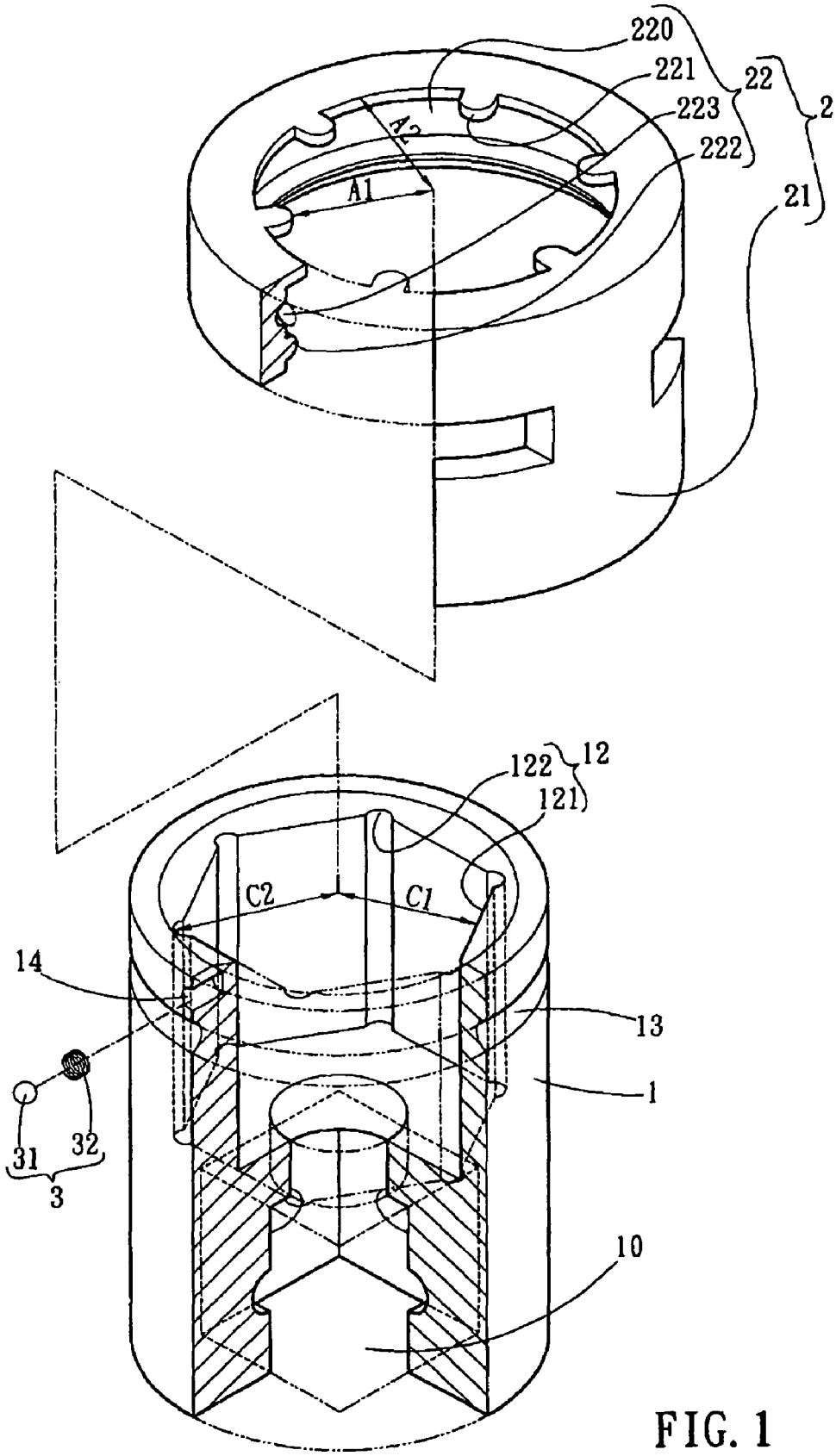
FIG. 1 is an exploded view to show the socket assembly of the present invention.
Figure 6:
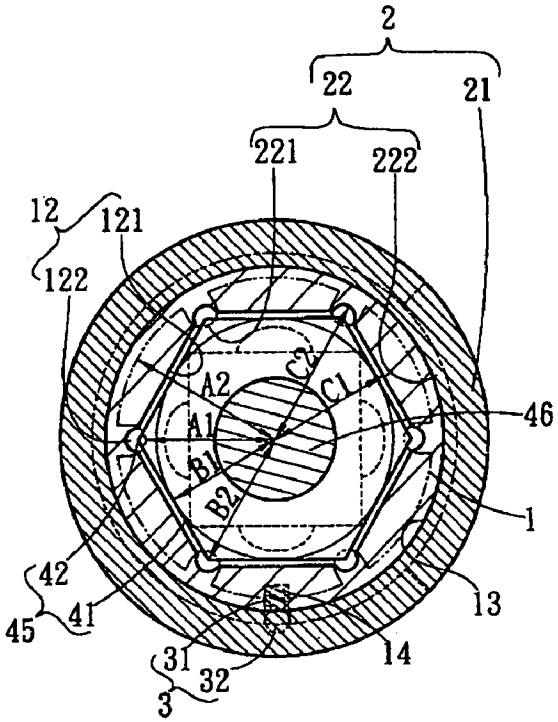
FIG. 6 is a cross sectional view, taken along line 7-7 in FIG. 5.
Figure 3:
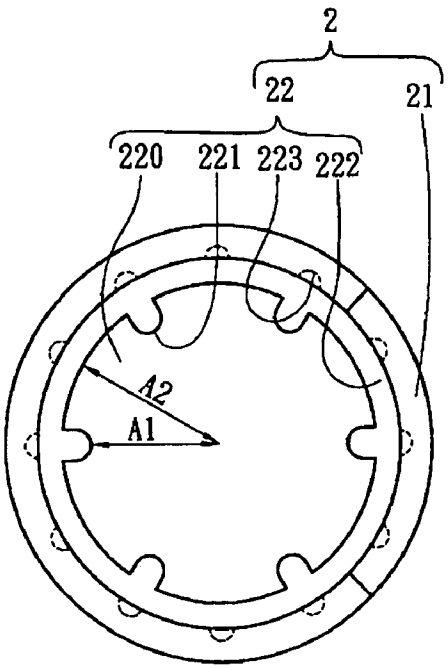
FIG. 3 is a top view to show the distances A1 and A2 of the control member.
Figure 2:
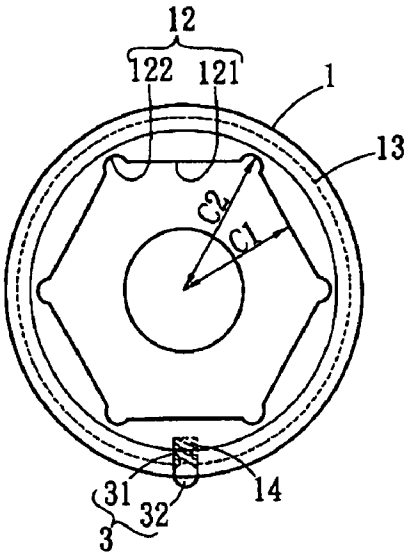
FIG. 2 is a top view to show the distances C1 and C2 of the socket.
Figure 4:
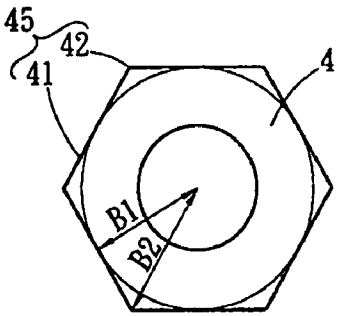
FIG. 4 is a top view to show the distances B1 and B2 of the polygonal object.
Figure 5:
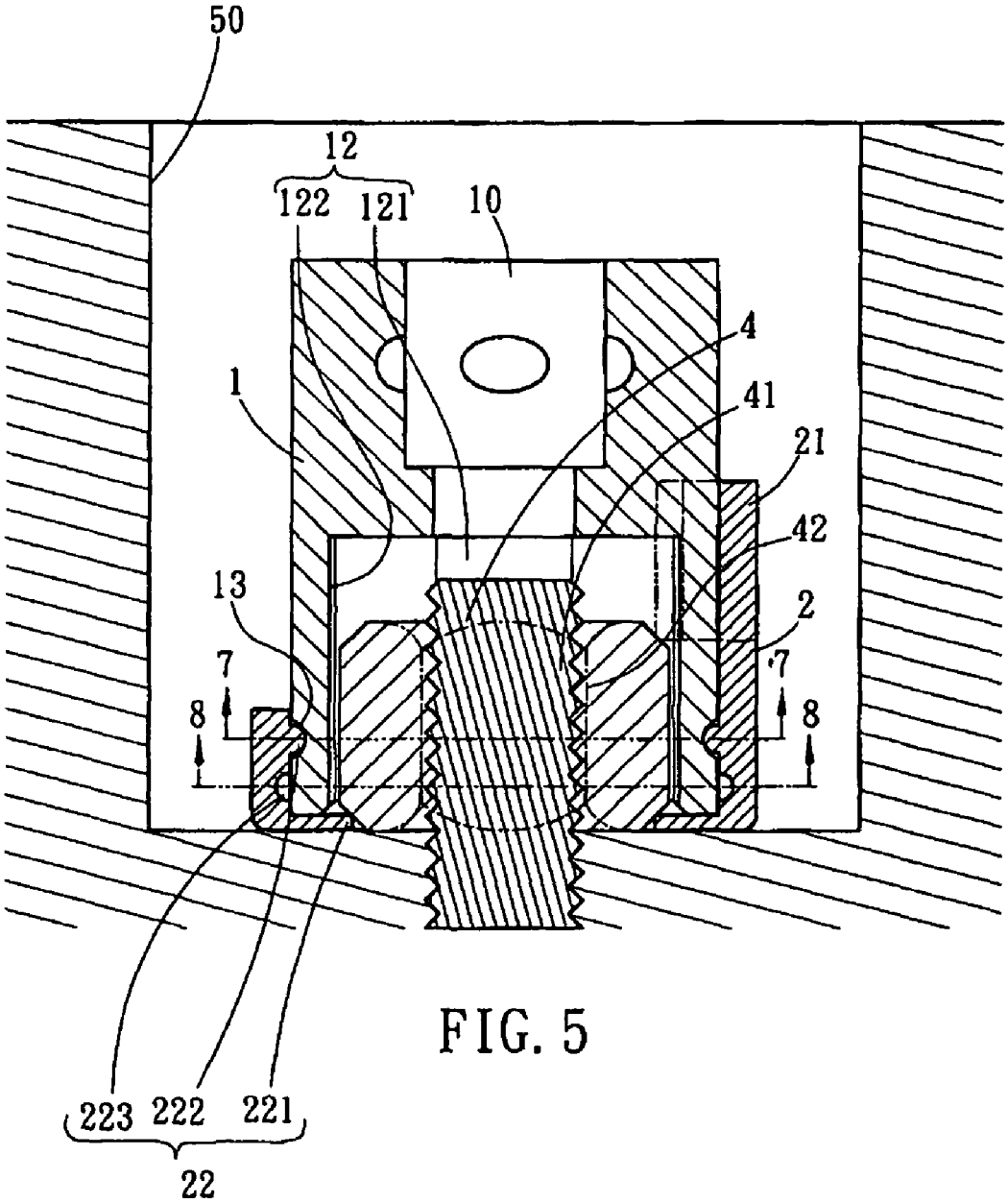
FIG. 5 is a cross sectional view to show that the object is engaged with the mounting hole of the socket.

Referring to FIGS. 1 to 5, the socket assembly of the present invention comprises a socket 1 and a control member 2. The socket 1 includes an engaging hole 10 defined in a first end thereof so as to be connected with a hand tool which is not shown, and a mounting hole 12 defined in a second end of the socket 1 so as to be mounted to a polygonal object 4. The mounting hole 12 is a polygonal hole and includes a plurality of insides 121 and yield recesses 122 which are located alternatively between the insides 121. The engaging hole 10 is in communication with the mounting hole 12. The socket 1 includes a positioning device which is a reception hole 14 defined radially through a wall of the socket 1 and a positioning unit 3 is engaged with the reception hole 14. The positioning unit 3 includes a bead 31 and a spring 32 which biases the bead 31 to partially protrude from the outer periphery of the socket 1. The positioning unit can be any known arrangement such as a single piece with a rounded end or wedged distal end.

The control member 2 is rotatably mounted to the socket 1 and includes an operation section 21 and a function section 22. The function section 22 is a ring-shaped portion and the operation section 21 is connected axially to the function section 22. The operation section 21 extends a distance beyond the function section and toward the engaging hole 10 of the socket 1 so that the user can easily access and operate the operation section 21, The function section 22 includes a through hole 220 defined centrally therethrough and a plurality of stops 221 extend inward from an inner periphery of the through hole 220. The stops 221 are made by resilient material so that the stops 221 can be deformed inward when a force is applied to the stops 221 along the axis of the through hole 220. That is to say, when mounting the socket 1 to the object 4, the object 4 can squeeze and deform the stops 221 by the corners 42 thereof. The stops 221 then bounce back after the object 4 passes through the stops 221. The control member 2 further includes a plurality of notches 223 defined in an inner periphery of the through hole 220 so that the bead 31 of the positioning unit 3 in the socket 1 is removably engaged with one of the notches 223 so as to position the control member 2 to the socket 1. A ridge 222 extends inward from an inner periphery thereof so as to be movably engaged with a groove 13 defined in an outer periphery of the socket 1 about an axis of the socket 1.

The polygonal object 4 such as a nut includes six sides 41 and six corners 42 are connected between the sides 41.

Figure 8:
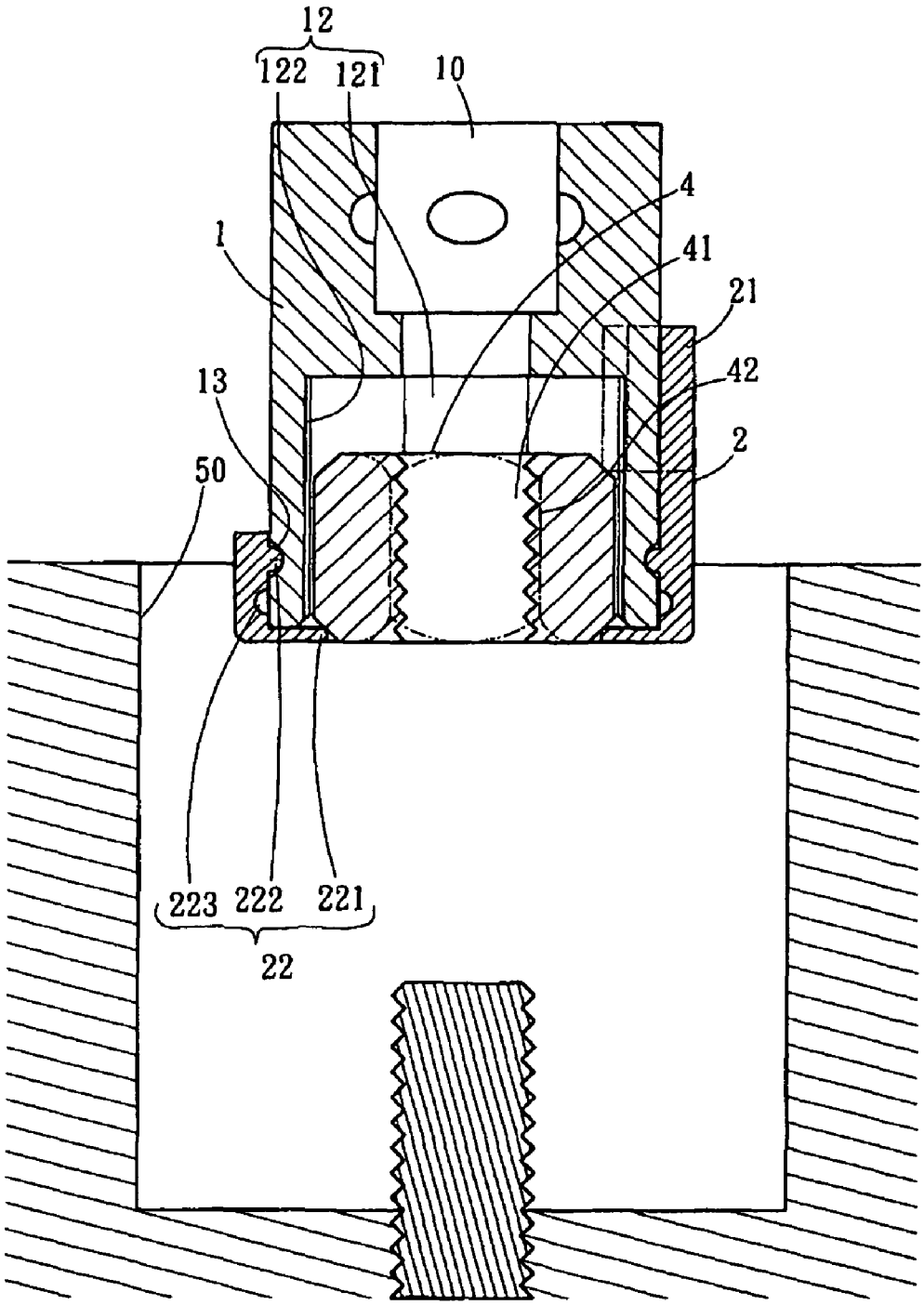
FIG. 8 shows that the polygonal object is separated from the threaded rod and received in the mounting hole by the stops of the control member.

The distance "A1" from an axis of the control member to each one of the stops of the control member is not smaller than the distance "C1" from the axis of the socket 1 to each of the insides 121 of the socket 1 and not larger than the distance "C2" from the axis of the socket 1 to each of the yield recesses 122 of the socket 1. The distance "A2" from an axis of the control member to the inner periphery of the through hole being not smaller than the distance "C2" from the axis of the socket to each of the yield recesses of the socket, and Further referring to FIGS. 5, 6, 7 and 8, when mounting the socket 1 to the object 4, the stops 221 are pushed to be deformed so that the object 4 is engaged with the mounting hole 12 of the socket 1. The stops 221 are located at the paths from which the corners 42 of the object 4 will drop. The sides 41 of the object 4 are matched with the insides 121 of the mounting hole 12. The socket 1 is then rotated and the object 4 is driven by the insides 121 of the mounting hole 12, so that the object 4 is loosened from the threaded rod as shown in FIG. 8. Because the stops 121 are located in alignment with the yield recesses 122 of the through hole 12, so that the corners 42 of the object 4 are supported by the stops 221 and does not drop from the mounting hole 17. The user can remove the socket 1 and the object 4 from the deep position together.

Figure 11:
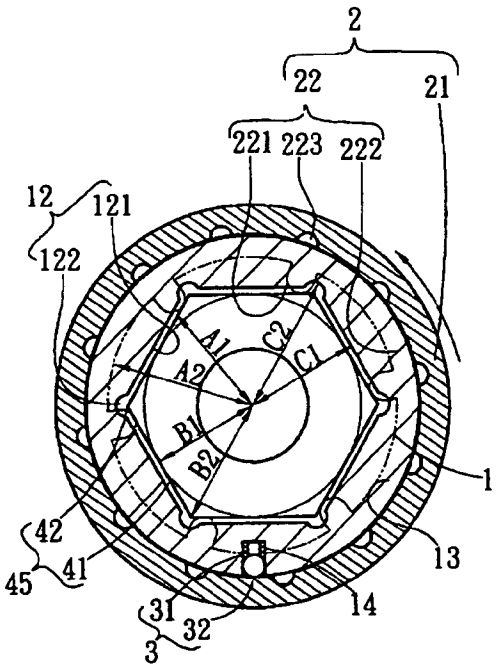
FIG. 11 is a cross sectional view, taken along line 10-10 in FIG. 9.
Figure 10:
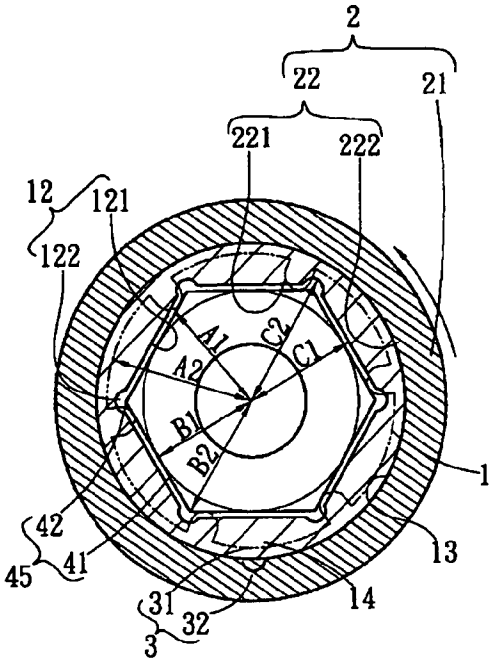
FIG. 10 is a cross sectional view, taken along line 9-9 in FIG. 9.
Figure 7:
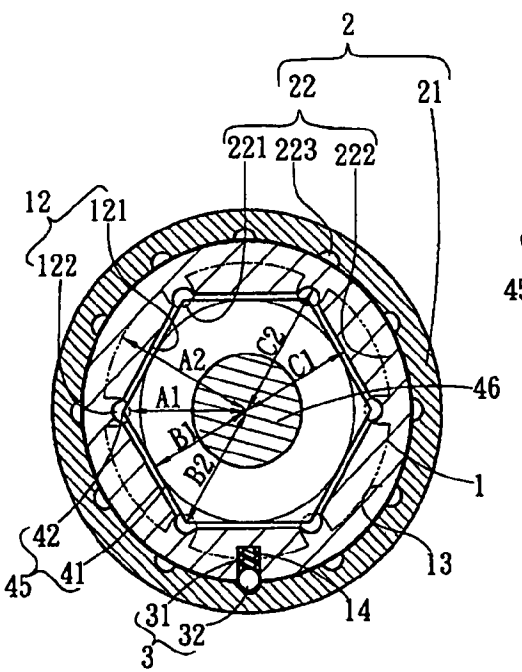
FIG. 7 is a cross sectional view, taken along line 8-8 in FIG. 5.
Figure 9:
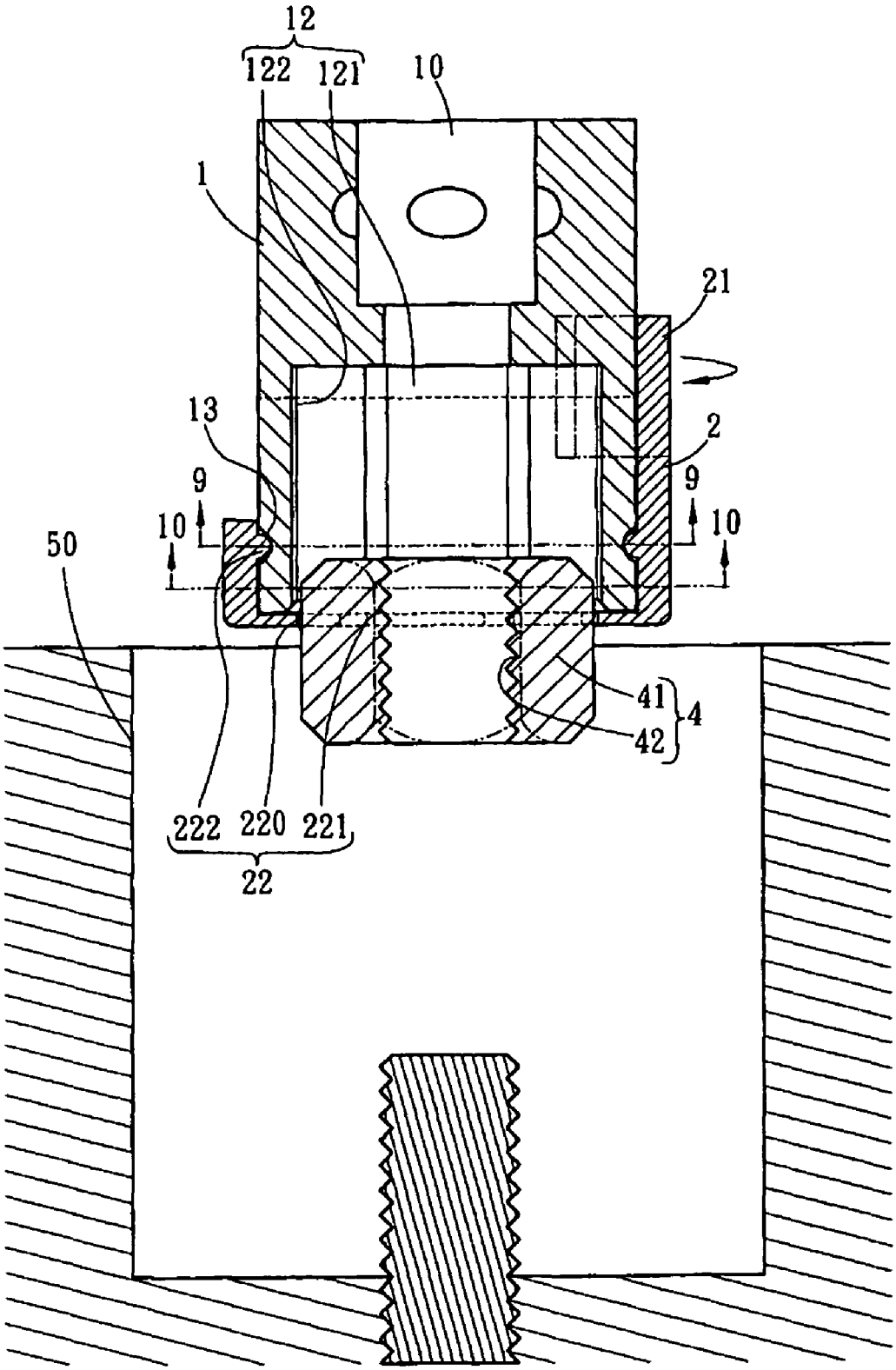
FIG. 9 shows that the polygonal object drops from the mounting hole by rotating the control to shift the stops.
Figure 12:
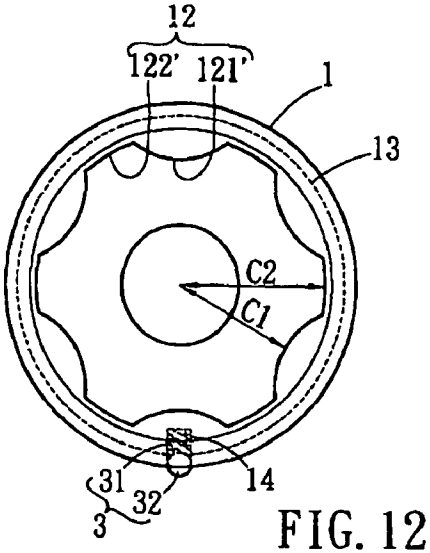
FIG. 12 shows a second embodiment of the mounting hole of the socket.
Figure 14:
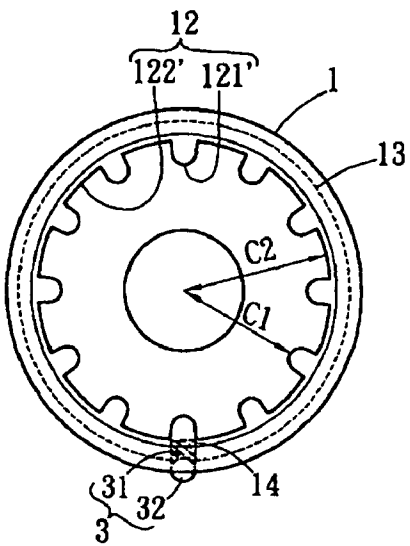
FIG. 14 shows a fourth embodiment of the mounting hole of the socket.
Figure 13:
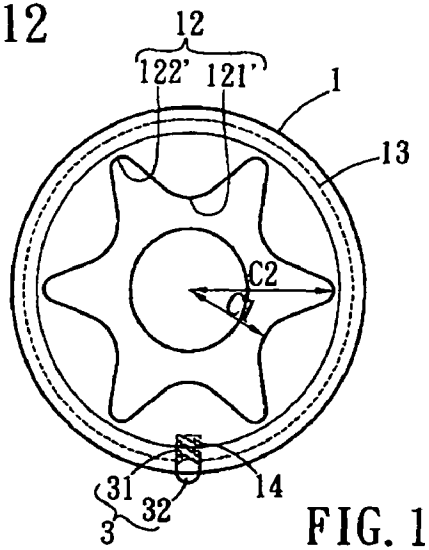
FIG. 13 shows a third embodiment of the mounting hole of the socket.
Figure 15:
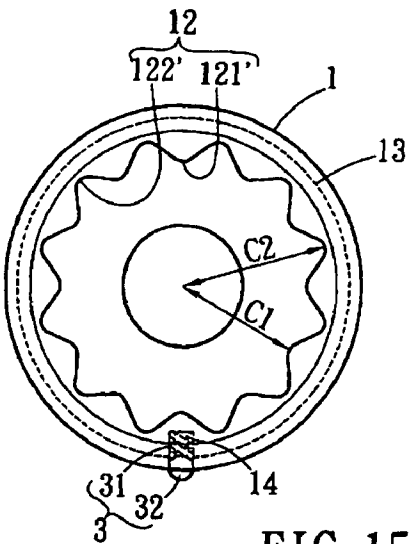
FIG. 15 shows a fifth embodiment of the mounting hole of the socket.

As shown in FIGS. 9, 10 and 11, the user then rotates the control member 2 by the operation section 21, the stops 221 are then shifted to off-align the yield recesses 122, the object 3 is then easily removed from the mounting hole 12.

It is noted that during use, the control member 2 is kept at the position wherein the stops 221 are in alignment with the yield recesses 122. The user does not need to operate the control member 2 when mounting the socket 1 to the object 4 and removing the socket 1 with the loosened object 4 from the deep position. The only operation to the control member 2 is when removing the object 4 from the mounting hole 12.

The socket assembly simply includes a control member 2 to obtain the extra function during use. The control member 2 includes all the functions that the insert and the rotatable ring of U.S. Pat. No. 7,243,579.

The positioning unit 3 can be a one-piece unit such as a single spring or a single rod with a rounded end.

It is noted that the shape of the mounting hole 12 of the socket 1 can be any known shape such as the shapes shown in FIGS. 12 to 15. Each of the shapes includes curved protrusions 121' and yield notches 122'.

While we have shown and described the embodiment in accordance with the present invention, it should be clear to those skilled in the art that further embodiments may be made without departing from the scope of the present invention.

What is claimed is:

1. A socket assembly comprising:

a socket having an engaging hole defined in a first end thereof and a mounting hole defined in a second end of the socket, the mounting hole including a plurality of insides and yield recesses which are located alternatively between the insides, a groove defined in an outer periphery of the socket about an axis of the socket;

a control member rotatably mounted to the socket and having a through hole defined centrally therethrough and a plurality of stops extending inward from an inner periphery of the through hole, the stops being deformable when a force applies to the stops along the axis of the through hole, a ridge extending inward from an inner periphery thereof, the ridge movably engaged with the groove, the socket including a positioning device and the control member including a plurality of notches defined in an inner periphery of the through hole, the positioning device removably engaged with one of the notches;

a distance "A1" from an axis of the control member to each one of the stops of the control member being not smaller than a distance "C1" from the axis of the socket to each of the insides of the socket and not larger than a distance "C2" from the axis of the socket to each of the yield recesses of the socket, a distance "A2" from the axis of the control member to the inner periphery of the through hole being not smaller than a distance "C2" from the axis of the socket to each of the yield recesses of the socket, and the control member being rotated between a first position where the stops of the control member are located on paths that corners of an object to be loosened drop from the mounting hole, and a second position wherein the stops of the control member are located in alignment with the yield recesses of the mounting hole of the socket.

2. The assembly as claimed in claim 1, wherein the positioning device is a reception hole defined radially through a wall of the socket and a positioning unit is engaged with the reception hole, the positioning unit includes a bead and a spring which biases the bead to partially protrude from the outer periphery of the socket, the bead engaged with one of the notches.

3. The assembly as claimed in claim 1, wherein the control member includes an operation section and a function section, the function section is a ring-shaped portion and the operation section extends axially a distance beyond the function section and toward the first end of the socket.

4. The assembly as claimed in claim 1, wherein the distance "A1" from an axis of the control member to each one of the stops of the control member is larger than a distance "B1" from an axis of the object to each one of the sides of the object.

5. The assembly as claimed in claim 1, wherein the control member is rotatable about the axis of the socket.

6. The assembly as claimed in claim 1, wherein the shape of the through hole of the control member is the same as the shape of the mounting hole of the socket.

7. The assembly as claimed in claim 1, wherein the engaging hole is in communication with the mounting hole.

* * * * *